United States Patent [19]

Campbell

[11] Patent Number: 4,696,755

[45] Date of Patent: Sep. 29, 1987

[54] LUBRICATING OIL COMPOSITIONS CONTAINING HYDROXY POLYETHER POLYAMINES

[75] Inventor: Curtis B. Campbell, Rodeo, Calif.

[73] Assignee: Chevron Research Company, San Francisco, Calif.

[21] Appl. No.: 687,046

[22] Filed: Dec. 28, 1984

Related U.S. Application Data

[63] Continuation-in-part of Ser. No. 547,558, Oct. 31, 1983, abandoned.

[51] Int. Cl.[4] ..... C10M 119/24

[52] U.S. Cl. ..... 252/515 R

[58] Field of Search ..... 252/51.5 R; 547/558

[56] References Cited

U.S. PATENT DOCUMENTS

| | | | |
|---|---|---|---|
| 2,522,155 | 9/1950 | Ballard et al. | 252/51.5 |
| 3,030,197 | 4/1962 | Godar et al. | 44/72 |
| 3,231,619 | 1/1966 | Speranza | 260/584 |
| 3,440,029 | 4/1969 | Little et al. | 44/75 |
| 3,456,013 | 7/1969 | Egan et al. | 260/584 |
| 4,151,670 | 2/1981 | Cummings | 560/169 |
| 4,247,301 | 1/1981 | Honnen | 44/63 |
| 4,261,704 | 4/1981 | Langdon | 44/62 |
| 4,332,595 | 6/1982 | Herbstman et al. | 44/72 |

FOREIGN PATENT DOCUMENTS 1464341 1/1963 United Kingdom .

*Primary Examiner*—William R. Dixon, Jr.
*Assistant Examiner*—Cynthia A. Prezlock
*Attorney, Agent, or Firm*—S. R. LaPaglia; R. C. Gaffney; J. J. DeYoung

[57] ABSTRACT

Lubricating oils containing an additive which contributes dispersancy and detergency to the lubricating oils are provided. The additives comprise hydroxy polyether amines of the general formula:

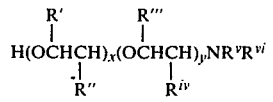

The additive is present in the lubricating oil in a concentration of from about 0.01 to 10 percent by weight.

6 Claims, No Drawings

LUBRICATING OIL COMPOSITIONS CONTAINING HYDROXY POLYETHER POLYAMINES

CROSS-REFERENCE TO RELATED APPLICATIONS

This application is a continuation-in-part of pending application Ser. No. 547,558, filed on Oct. 31, 1983, which is now abandoned.

BACKGROUND OF THE INVENTION

1. Field of the Invention

This application relates to lubricating oil compositions containing hydroxy polyether amines which contribute dispersancy and detergency to the compositions.

Lubricating oil compositions, particularly for use in internal combustion engines, have long performed many functions other than simply lubricating moving parts. Modern-day, highly compounded lubricating oil compositions provide anti-wear, anti-oxidant, extreme-pressure and anti-rust protection in addition to maintaining the cleanliness of the engine by dispersancy and detergency. Many lubricating oil additives are well known for accomplishing theses functions. For maintaining engine cleanliness, a well-known class of ashless detergents which have been found to be particularly useful are polyoxyalkylene carbamates. U.S. Pat, Nos. 4,160,648 and 4,247,301 disclose and claim fuel compositions containing certain poly(oxyalkylene)aminocarbamates and polyoxyalkylene polyamines as deposit control additives. While, in general, deposit control additives are not believed to be useful dispersants for lubricating oil compositions; generally, certain aminocarbamates and certain polyether amines are useful in this regard.

2. Prior Art

Polyether amine-type fuel additives for deposit control and lubricating oil dispersancy are well-known but have traditionally been surfactant-type molecules having a large, non-polar hydrophobic end or "tail", for instance, a hydrocarbyl capped polyether moiety, and a polar, hydrophilic amine or polyamine end. Examples of these type of compositions may be found in U.S. Pat. No. 4,233,168; U.S. Pat. No. 4,160,648; U.S. Pat. No. 4,438,022; U.S. Pat. No. 4,537,693. In the present invention, however, a composition has been discovered which in lubricating oil functions as a dispersant and detergent additive which has a single hydroxyl group in the non-polar hydrophobic portion of the molecule. These additives contain block co-polymer polyethers in which there is no hydrocarbyl cap.

DESCRIPTION OF THE INVENTION

The present invention herein consists of a hydroxy polyether amine or polyamine additive, and a lubricating oil composition containing a major amount of oil of lubricating viscosity and from about 0.01 to about 10 weight percent of said additive. The additives consist of certain lubricating oil soluble hydroxy polyoxyalkylene polyamines. These additives have the following general formula:

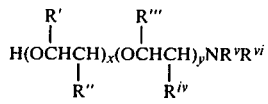

wherein:

R′ and R″ independently =H, or alkyl groups of 1 to 4 carbon atoms, and at least one of R′ and R″ has at least 2 carbon atoms;

R‴ and $R^{iv}$ independently =H or $CH_3$;

$R^{v}$ and $R^{vi}$ independently =H or

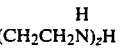

where Z=1 to 5; and x and y independently are integers from 1 to 30.

The compositions may be either mono or polyamines, but polyamines are preferred. The additive compounds have molecular weights of from about 500 to 2000, and preferably from about 700 to 1200.

Among other things, this invention is based on my discovery that the hydrophobic portion of a polyether polyamine fuel additive may contain an "uncapped" hydroxyl group, provided that the polyether is a co-polymer and that the portion of the co-polymer having the hydroxyl group has more carbon atoms per unit than the other portion of the block co-polymer. Thus, a preferred compound is composed of a block co-polymer in which the hydroxyl-containing portion is composed of poly(butylene glycol) and the other portion is composed of poly(ethylene glycol). Furthermore, it is preferred that R′ has at least 2 carbon atoms, and that R″, R‴ and $R^{iv}$ are H.

As lubricating oil additives, the specific compositions are selected to provide stability in lubricating oil compositions with dispersant activity, without contributing to deposit formation in the lubricating oil composition.

The oils which find use in this invention are oils of lubricating viscosity derived from petroleum or synthetic sources. Oils of lubricating viscosity normally have viscosities in the range of 35 to 50,000 Saybolt Universal Seconds (SUS) at 100° F. and more usually from about 50 to 10,000 SUS at 100° F. Examples of such base oils are naphthenic bases, paraffin base and mixed base mineral oils, synthetic oils; for example, alkylene polymers, such as the polymers or propylene, butylene, etc., and mixtures thereof.

Usually included in the oils besides the subject additives are such additives as dispersant/detergents, rust inhibitors, antioxidants, oiliness agents, foam inhibitors, viscosity index improvers, pour point depressants, etc. Usually, these other additives will be present in amounts of from about 0.5 to 15 weight percent of the total composition. Generally, each of the additives will be present in the range from about 0.01 to 5 weight percent of the total composition.

It is also contemplated that the additive compositions may be used as concentrates, and could be used as additive to fuels or lubricating oils subsequent to their preparation. In concentrates, the weight percent of these additives will usually range from about 0.3 to 50 weight percent. The concentrate would ordinarily comprise an inert stable olephilic organic solvent and the carrier of said solvent boiling in the range of from about 150° to 400° F. and the concentrate would preferably contain from about 10 to 50 weight percent of the additive compound. It is also contemplated that these additives are functional as deposit control additives in gasoline, in a concentration of from 250 ppm by weight to 5000 ppm by weight.

The additive compounds can be prepared by a variety of known processes. In a preferred embodiment, an appropriate hydroxy-substituted amine, containing both the desired amino moiety and the appropriate hydroxy-terminated alkyl moiety, is reacted with an appropriate alkylene oxide or other oxylating agent. The resulting polyether amine is then reacted with a second epoxyalkane having the desired R′ or R″ brand alkyl groups, at least one of which has at least 2 carbon atoms. Upon termination of the second epoxidation, a block copolymer is produced having a hydroxyl group near the end of the second polyether moiety.

In another embodiment, a halohydroxyalkylene, preferably chlorohydroxyalkylene is first reacted at the hydroxy terminus with an appropriate alkylene oxide. The halo group is then reacted with an amine or polyamine, preferably in excess to yield the hydroxy poly(oxyalkylene)amines or polyamines of this invention. Examples of suitable halohydroxyalkylenes include 2-chloroethanol, 2-chloropropanol, and the like.

The preparation of the compound is illustrated by, but not intended to be limited to, the following example for the preparation of

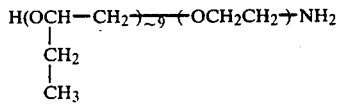

EXAMPLE

A solution of 10 ml (139 mmol) 2-(2-aminoethoxy)ethanol in 275 ml of dioxane was azeotropically dried by distilling off 25 ml in a nitrogen atmosphere. The solution was cooled to 0°-5° C. in an ice bath and approx. 6.5 gms (approx. 167 mmols) of potassium metal cut into small pieces was added with stirring while flushing the flask with nitrogen. After the addition was completed, the slurry was warmed to room temperature over 48 hours, and any unreacted potassium metal (approx. 1 gm, 26 mmols) was removed from the reaction.

The resulting slurry was heated to approx. 90° C. and 100 ml (1.16 moles) of distilled 1,2-epoxybutane was added over 30 minutes. After this addition, the reaction was stirred with heating for 30 minutes and then cooled to room temperature and stirred for 16 hours.

The reaction was quenched by adding approx. 200 ml of t-butanol and stirring 30 minutes, followed by approx. 50 ml of water. The reaction was diluted with 300 ml ether and extracted with two 100 ml portions of water.

Sufficient 10% aqueous HCl was added to the water extraction to bring the aqueous layer to about pH 7.

The product was washed with additional water, and the organic layer dried over anhydrous $K_2CO_3$. After filtration and concentration in vacuo, 98.2 gms (94% mass recovery) of a yellow oil was isolated: Basic N=0.84%; MW=759±2; hydroxyl number=125; and C=65.76%, H=11.31%, N=0.85%.

By Carbon[13] NMR, no secondary amine was present indicating no polymerization at the amine nitrogen took place.

All specific embodiments of the invention have been described in detail. It should be understood that the invention is to be given the broadest possible interpretation within the terms of the following claims.

What is claimed is:

1. A lubricating oil composition comprising a major portion of an oil of lubricating viscosity, and a dispersant effective amount of an additive having the formula:

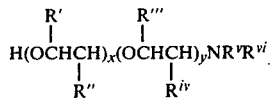

wherein:

R′ and R″ independently are selected from the group consisting of hydrogen and alkyl groups having from 1 to 4 carbon atoms, and where at least one of R′ and R″ has at least 2 carbon atoms; R‴ and $R^{iv}$ are independently hydrogen or methyl; $R^{v}$ and $R^{vi}$ independently are hydrogen or

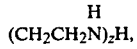

where z is an integer from 1 to 5; x and y independently are integers from 1 to 30; and wherein

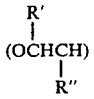

contains more carbon atoms than

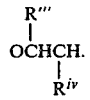

2. A lubricating oil composition as claimed in claim 1, wherein said additive has a molecular weight of from about 500 to about 2000.

3. A lubricating oil composition as claimed in claim 2, wherein said molecular weight is from about 700 to about 1200.

4. A lubricating oil composition as claimed in claim 1, wherein R′ is ethyl, R″ is hydrogen, R‴ and $R^{iv}$ are hydrogen, $R^{v}$ and $R^{vi}$ are hydrogen, x is from 5 to 10, and y is from 1 to 5.

5. A lubricating oil composition as claimed in claim 4, wherein y is 2 and x is 9.

6. A lubricating oil composition as claimed in claim 1, 2, 3, 4 or 5, wherein said additive comprises from about 0.01 to about 10 percent by weight of the total composition.

* * * * *